US005370326A

United States Patent [19]

Webb

[11] Patent Number: 5,370,326

[45] Date of Patent: Dec. 6, 1994

[54] SPOOL REWINDER

[76] Inventor: LLoyd A. Webb, P.O. Box 4502, Midland, Tex. 79704

[21] Appl. No.: 22,678

[22] Filed: Mar. 1, 1993

[51] Int. Cl.[5] ..... B65H 54/74; B65H 79/00

[52] U.S. Cl. ..... 242/47; 242/395; 242/470; 242/597.4; 242/597.6

[58] Field of Search ..... 242/47, 53, 106, 54 R, 242/96, 85, 1, 395, 470, 597.4, 597.6

[56] References Cited

U.S. PATENT DOCUMENTS

| | | | |
|---|---|---|---|
| 3,647,155 | 3/1972 | Jorgenson | 242/106 |
| 3,973,741 | 8/1976 | Dean | 242/106 |
| 4,196,864 | 4/1980 | Cole | 242/106 X |
| 4,310,126 | 1/1982 | Norleen | 242/47 |
| 5,163,632 | 11/1992 | Chilcoat et al. | 242/47 |

*Primary Examiner*—Stanley N. Gilreath
*Attorney, Agent, or Firm*—Jeffrey E. Griffin

[57] ABSTRACT

A device used for winding line from a bulk supply onto a reusable spool. The empty spool is placed on a shaft having a plate on one end to hold the spool and a threaded portion on the other end. Then, the shaft is positioned through a sleeve with an integral plate for holding the spool. The sleeve rests in a bearing member supported by a base. A hub with internal threads screws onto the shaft pulling the two plates together. Once the spool is held tightly between the two plates, the hub engages the sleeve and the spool begins to rotate with the hub, sleeve, plates, and shaft.

14 Claims, 2 Drawing Sheets

SPOOL REWINDER

BACKGROUND OF THE INVENTION

1. Field of Invention

This invention relates to a rewinding accessory for monofilament lawn line trimmer devices. More specifically, it is directed to an improved, low cost rewinder that enables users of lawn trimmers to replace a worn monofilament line with maximum efficiency and in the shortest possible time thereby saving time and money.

Monofilament line used in weed trimmers is available both on spools ready for use or in bulk. The spools are reusable and are characterized generally by a cylindrical or tubular hub with spaced flanges to confine the trimmer line. The size of the spools varies according to the type of trimmer and amount of line on the spool. The line sold in bulk is substantially less expensive than the spooled line but requires winding onto a spool before use. Thus, people who use a great deal of the line may obtain substantial savings by buying the line in bulk and rewinding the line onto a spool. However, the monofilament line used in the trimmers is relatively stiff and resilient making difficult re-spooling by hand. Consequently, a device to hold and turn the spool for rewinding the line onto the spool makes the job of re-spooling simpler and less time consuming. Because the size of spools does vary, the re-spooling device should adapt to a range of spool sizes.

2. Related Art

Rewinding devices have long been known to the prior art. Illustrative of such rewinders are U.S. Pat. No. 4,717,086 which issued on Jan. 5, 1988 and U.S. Pat. No. 4,762,286 which issued on Aug. 9, 1988. Such rewinders have disc elements adapted to receive an empty spool and a rotating drive crank which facilitates rotation of the spool. Both of these devices uses a spring element to hold the spool in place and compensate for the variety of spool widths. Neither of these devices provides a truly simple remedy for the problem of compensating for various sizes and types of spools. The device shown in U.S. Pat. No. 4,717,086 uses a spring element and a plurality of notches in a shaft in combination with an arm attached to one of the disk elements for adapting to different widths of spools. Likewise, the device shown in U.S. Pat. No. 4,762,286 uses prongs extending from the disc element to engage the spool and facilitate rotation of the spool thereby limiting its universality to various sized spools.

Another prior effort to design a spool rewinding device is illustrated by U.S. Pat. No. 4,728,048. This rewinder also uses a spring to hold the spool in place. However, the device uses a disk and a frusto conical shaped element to receive the empty spool and help accommodate for different sized spools. The device uses a power drill to facilitate rewinding.

Other pertinent examples of rewinders include those revealed in U.S. Pat. Nos. 3,979,833 and 4,164,332, and 4,442,984 none of which deal with lawn trimmer spools.

Though the above mentioned rewinders may be helpful in rewinding lawn trimmer spools, they can be improved to provide faster rewinding and greater universality with a lower cost, positive drive clamping combination.

SUMMARY OF THE INVENTION

To achieve such improvements, my invention includes a cooperative cam means used to bias a spool between two gripping means while at the same time providing a means for rotation of the spool. The device comprises a plate having a generally flat surface on one side for receiving and mating with one side of an empty monofilament line spool. Extending from the flat side of the plate and removably through the spool, is a shaft mounted substantially near the center of the plate. The end of the shaft distal to the plate being threaded. The shaft also extends rotatably and removably through the spool and a second plate having a generally flat surface on one side for receiving and mating with the other side of the empty monofilament line spool. Extending from the opposite side of the second plate is a sleeve mounted substantially near the center of the plate. The threaded end of the shaft also extends rotatably and removably through the sleeve. Threadly engaging the threaded end of the shaft is a crank arm with a threaded aperture for simultaneously pulling the two plates into tight, frictional driving relationship with the empty spool, for accommodating different sized spools, and for rotating the spool for replacing a monofilament line thereon.

Accordingly, the objectives of this invention are to provide, inter alia, 1. a spool rewinding device that combines the means for gripping an empty monofilament line dispenser spool with the means for rotating the spool;
2. a spool rewinding device that provides a simple, continuous system for adapting to different sizes of spools and provides for greater universality;
3. a simple, spool rewinding device that eliminates components found in earlier inventions, such as springs, to decrease assembly time and complexity and to provide greater reliability and tool life;
4. a spool rewinding device of relatively low cost for reducing the time required for winding monofilament line onto a spool;
5. a spool rewinding device that is safe for use by the general public especially home use.

BRIEF DESCRIPTION OF THE DRAWING

The manner in which these objectives and other desirable characteristics can be obtained is explained in the following description and attached drawings in which.

DETAILED DESCRIPTION OF THE INVENTION

Figure 1:
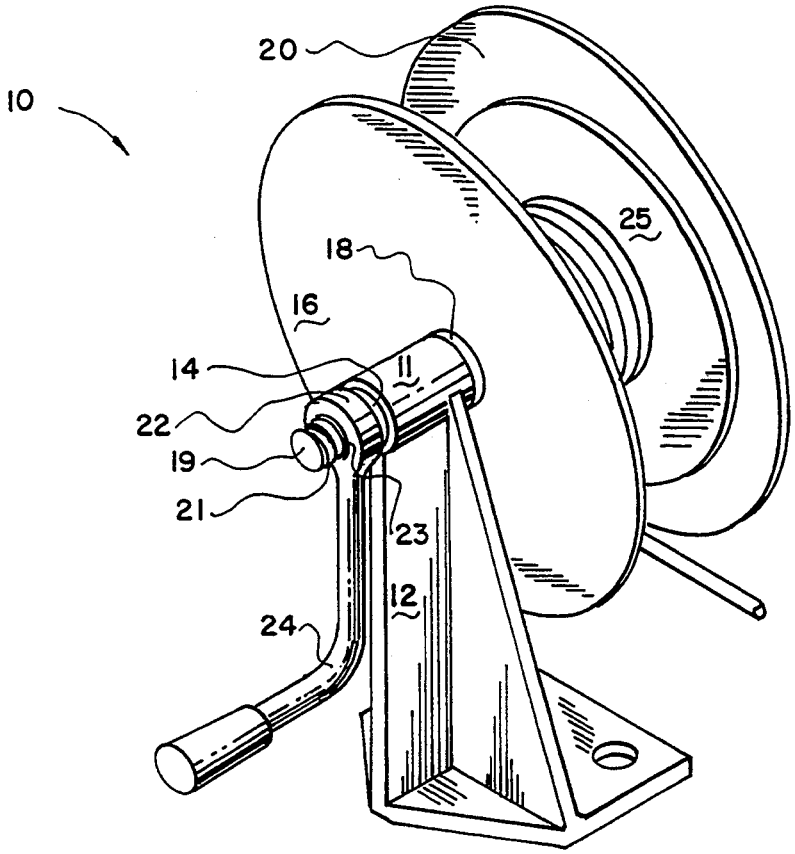
FIG. 1 is an isometric view of the spool rewinder showing its application to a partially wound spool.
Figure 2:
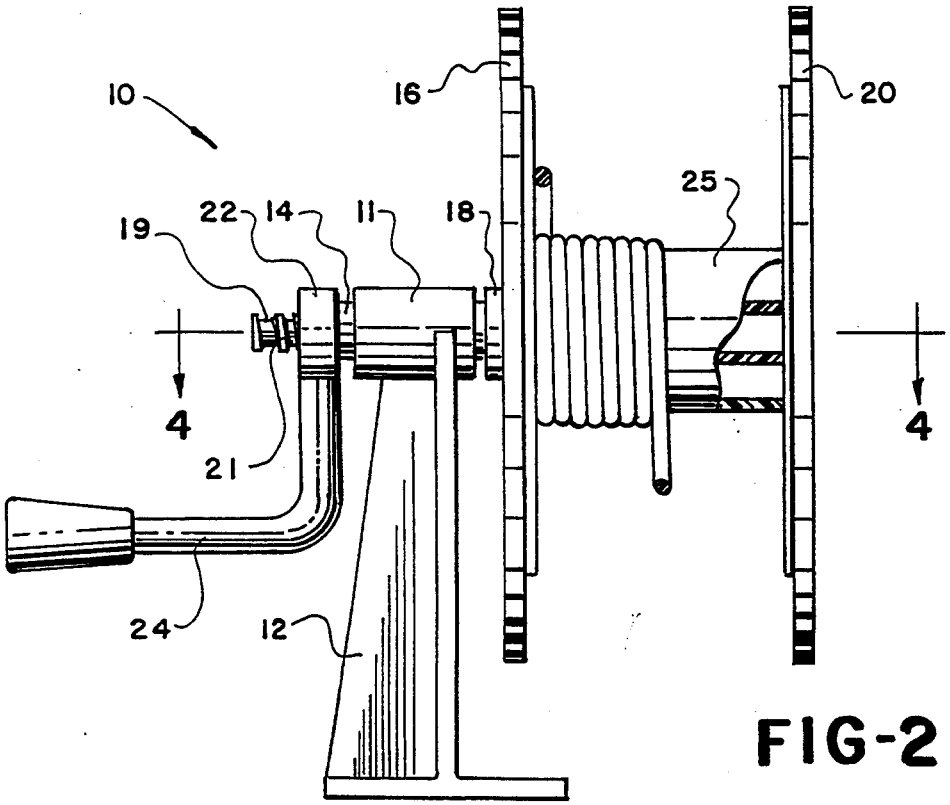
FIG. 2 is a side elevational view of the spool rewinder gripping a spool with portions broken away to reveal the internal support structure of the spool.
Figure 3:
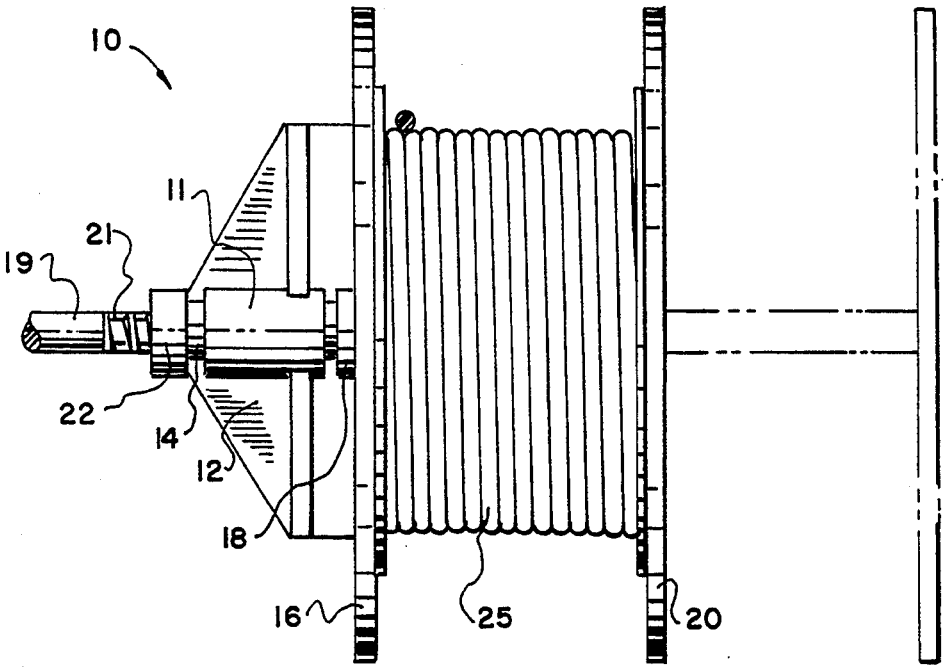
FIG. 3 is a top elevational view of the spool rewinder demonstrating how the shaft and gripping means are removable to permit placement of spools on the device.

The preferred embodiment of my invention is illustrated in FIGS. 1 through 3 and the spool rewinder is depicted as 10. The spool rewinder comprises a bearing member 11 with an integral base 12. The base 12 acts as a bracing means for the spool rewinder 10. A bore 13 (FIG. 4) extends through the bearing member 11.

Figure 4:
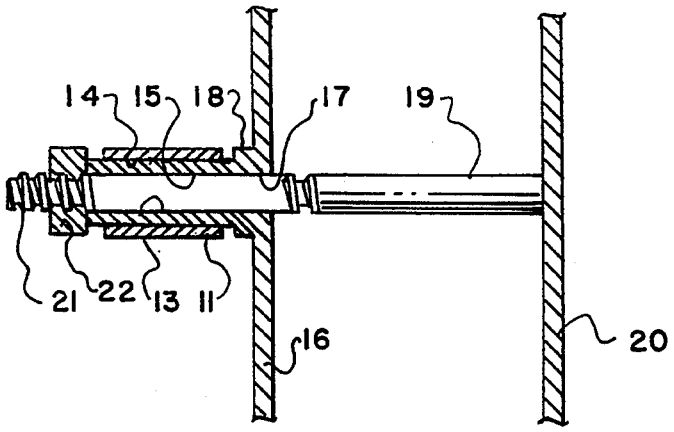
FIG. 4 is a sectional view taken along lines 4—4 in FIG. 2 used to show the inter-workings of the spool rewinder.

Extending through the bore 13 is a sleeve 14. Consequently, the bearing member 11 behaves as a supporting means for the sleeve 14. The length of the sleeve 14 is preferably greater than the length of the bearing member 11 and a bore 15 (FIG. 4) extends through the sleeve 14. Adjacent to and preferably integral with the sleeve 14 is a plate 16 with one side designed for receiving and mating with one side of a monofilament spool 25. The plate has a bore 17 (FIG. 4) that is substantially coaxial with the sleeve bore 15 (FIG. 4). Also, in the preferred embodiment the plate has a shoulder surface 18 integral with the side of the plate nearest the sleeve 14. When a shoulder surface 18 is present, the sleeve 14 is attached to the shoulder surface 18 which is connected to the plate 16. Depending on the size and shape of the sleeve 14, the plate 16 may be nonessential because the end of the sleeve could replace the plate. If a plate 16 is not used, the sleeve has one end designed for receiving and mating with one side of a monofilament line spool 25. One such example of a size and shape variation, is if the diameter of the sleeve 14 is great enough so as to provide a sufficient engagement surface for the spool 25.

The purpose of the sleeve 14 is to act as a shaft supporting means for a shaft 19 having opposing ends. One end of the shaft 19 has an integral plate 20. The plate 20 has one side designed for receiving and mating with the other side of the monofilament spool 25. The end of the shaft distal to the plate 20 has a threaded portion 21 or cooperating cam means and extends through the plate bore 17 and sleeve bore 15 (FIG. 4).

A hub 22 contains a threaded bore 23 (FIG. 4) or cooperating cam means. Attached to the hub 22 is a hand crank 24. The hand crank 24 acts as a means for rotating and screwing the hub 22 onto the threaded portion 21 of the shaft 19. The threaded portion of the shaft and the threaded bore 23 of the hub 22 act as a cooperating cam means for simultaneously pulling the plate 20, plate 16 and sleeve 14 into tight, frictional driving relationship with the spool 25 and rotating the spool for replacing a monofilament line thereon.

When the spool 25 is placed between the two plates 16 and 20, the plates serve as a spool gripping means to hold the spool 25. As the hub 22 screws onto the shaft 19, the plate 20 forces or biases the spool 25 against the other plate 16, if present. Since the sleeve 14 is longer than the bearing member 11, the hub 22 engages the sleeve 14 as the hub screws on the shaft 19. So, when the hub 22 sufficiently engages the sleeve 14 and tightly holds the spool 25, the shaft 19, sleeve 14, plates 16 and 20 and spool 25 turn with the hub 22 in the bearing member 11 allowing replacement of monofilament line on the spool.

I claim:

1. An improved, low cost monofilament spool rewinder comprising:

(a) a sleeve having a bore therein;

(b) a first plate having a bore therein and one side designed for receiving and mating with one side of a monofilament spool attached to an end of the sleeve;

(c) said first plate bore is substantially coaxial with the sleeve bore;

(d) a second plate having one side designed for receiving and mating with the other side of the monofilament spool, said one side having a shaft fixedly mounted centrally thereof;

(e) said shaft extending through the first plate bore and sleeve bore;

(f) a hub having a bore;

(g) the hub being removably mounted on the shaft;

(h) the hub and shaft having a cooperating cam means for simultaneously pulling the second plate, sleeve, and first plate into tight, frictional driving relationship with the spool and rotating the spool for replacing a monofilament line thereon.

2. An improved, low cost monofilament spool rewinder as claimed in claim 1 wherein the cooperating cam means comprises a threaded portion on the end of the shaft distal to the second plate and a threaded bore through the hub.

3. An improved, low cost monofilament spool rewinder as claimed in claim 1 further comprising a hand crank integral with the hub for rotating the hub.

4. An improved, low cost monofilament spool rewinder as claimed in claim 1 further comprising a bearing member having a bore for rotatably supporting the sleeve.

5. An improved, low cost monofilament spool rewinder as claimed in claim 4 further comprising a base extending from the bearing member.

6. A spool rewinder as claimed in claim 1 wherein the first plate is integral with the sleeve;

7. An improved, low cost monofilament spool rewinder comprising:

(a) a first disk-shaped plate having a generally flat surface on one side for receiving and mating with one side of an monofilament spool and a sleeve centrally mounted to and extending outwardly therefrom on the other side;

(b) the first plate and sleeve having a bore therethrough;

(c) the first plate having an integral shoulder surface on said other side;

(d) a second disk-shaped plate having a generally flat surface on one side for receiving and mating with the other side of the monofilament spool, said one side having a shaft fixedly mounted centrally thereof;

(e) said shaft extending through the spool and the first plate and sleeve bore and having a threaded end distal to the second plate;

(f) a bearing member having a bore therein for rotatably supporting the sleeve;

(g) a base extending from the bearing member whereby the spool rewinder may be supported during operation;

(h) a hub having a threaded bore and a hand crank extending therefrom for imparting rotational motion to the hub;

(i) the hub being removably and rotatably mounted on and threadly engaging the shaft whereby rotation of the hub simultaneously pulls the plates into tight, frictional driving relationship with the empty spool and rotates the spool for replacing a monofilament line thereon.

8. An improved, low cost monofilament spool rewinder comprising:

(a) a first plate having a bore therein and one side designed for receiving and mating with one side of a monofilament spool;

(b) a shoulder surface having a bore therein attached to the plate on a side opposite the side designed for receiving and mating with one side of a monofilament spool;

(c) a sleeve having a bore therein and one end attached to the shoulder surface;

(d) said first plate bore is substantially coaxial with the sleeve bore and the shoulder surface bore;

(e) a second plate having one side designed for receiving and mating with the other side of the monofilament spool, said one side having a shaft fixedly mounted centrally thereof;

(f) said shaft extending through the first plate bore, shoulder surface bore and sleeve bore;

(g) a hub having a bore;

(h) the hub being removably mounted on the shaft;

(i) the hub and shaft having a cooperating cam means for simultaneously pulling the second plate, sleeve, shoulder surface, and first plate into tight, frictional driving relationship with the spool and rotating the spool for replacing a monofilament line

9. An improved, low cost monofilament spool rewinder as claimed in claim 8 wherein the cooperating cam means comprises a threaded portion on the end of the shaft distal to the second plate and a threaded bore through the hub.

10. An improved, low cost monofilament spool rewinder as claimed in claim 8 further comprising a hand crank integral with the hub for rotating the hub.

11. An improved, low cost monofilament spool rewinder as claimed in claim 8 further comprising a bearing member having a bore for rotatably supporting the sleeve.

12. An improved, low cost monofilament spool rewinder as claimed in claim 11 further comprising a base extending from the bearing member.

13. A spool rewinder as claimed in claim 8 wherein the first plate is integral with the shoulder surface.

14. A spool rewinder as claimed in claim 8 wherein the shoulder surface is integral with the sleeve.

* * * * *